US005931230A

United States Patent [19]

Lesage et al.

[11] Patent Number: 5,931,230

[45] Date of Patent: Aug. 3, 1999

[54] VISICOUS OIL RECOVERY USING STEAM IN HORIZONTAL WELL

[75] Inventors: Robert P. Lesage, Calgary, Canada; Hong Sheh Lu, Plano, Tex.; Mehmet Saltuklaroglu, Calgary, Canada

[73] Assignee: Mobil Oil Corporation, Fairfax, Va.

[21] Appl. No.: 08/881,020

[22] Filed: Jun. 23, 1997

Related U.S. Application Data

[63] Continuation-in-part of application No. 08/604,060, Feb. 20, 1996, abandoned.

[51] Int. Cl.[6] ..... E21B 43/24

[52] U.S. Cl. ..... 166/303; 166/50

[58] Field of Search ..... 166/50, 303

[56] References Cited

U.S. PATENT DOCUMENTS

| | | | |
|---|---|---|---|
| 4,116,275 | 9/1978 | Butler et al. | 166/303 |
| 4,344,485 | 8/1982 | Butler | 166/271 |
| 5,141,054 | 8/1992 | Alameddine et al. | 166/252 |
| 5,148,869 | 9/1992 | Sanchez | 166/303 |
| 5,215,146 | 6/1993 | Sanchez | 166/263 |
| 5,215,149 | 6/1993 | Lu | 166/303 |
| 5,289,881 | 3/1994 | Schuh | 166/303 |
| 5,411,094 | 5/1995 | Northrop | 166/303 |
| 5,607,018 | 3/1997 | Schuh | 166/303 |
| 5,626,193 | 5/1997 | Nzekwu et al. | 166/303 |
| 5,655,605 | 8/1997 | Matthews | 166/50 |
| 5,771,973 | 6/1998 | Jensen et al. | 166/303 |

OTHER PUBLICATIONS

"Steam Circulation in Horizontal Wellbores", D.A. Best et al; SPE/DOE 20203; Tulsa, OK Apr. 22–25, 1990.

*Primary Examiner*—Hoang C. Dang
*Attorney, Agent, or Firm*—Malcolm D. Keen

[57] ABSTRACT

A method for recovering viscous oil from a subterranean formation through a wellbore having a horizontal section into the formation. Steam is circulated through the horizontal section to initially heat the formation and to produce fluids to the surface. After the initial heating is complete, production is ceased while the injection of steam is continued to accumulate a slug of steam within and around the horizontal section. The well is then shut-in and the formation is allowed to "soak". Production is then resumed and steam is again continuously injected into the well when oil appears in the produced fluids. This cycle is repeated until the production of oil drops belows an acceptable rate.

10 Claims, 1 Drawing Sheet

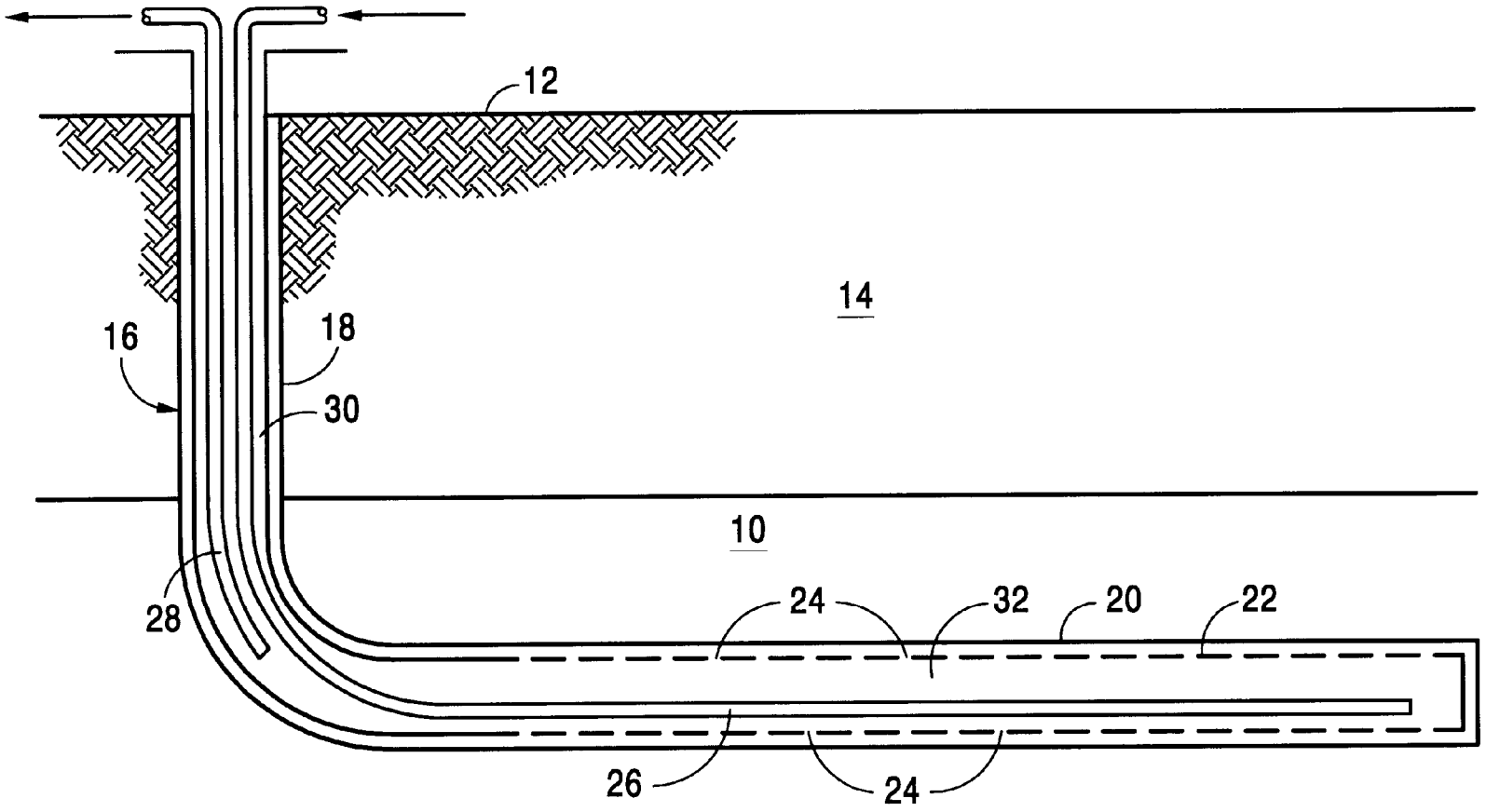
FIGURE

VISICOUS OIL RECOVERY USING STEAM IN HORIZONTAL WELL

CROSS-REFERENCE TO RELATED APPLICATION

This application is a continuation-in-part of U.S. application Ser. No. 08/604,060, filed Feb. 20, 1996, now abandoned.

DESCRIPTION

1. Technical Field

The present invention relates to a process for the recovery of highly viscous oil or hydrocarbons from subterranean reservoirs or formations and in one of its aspects relates to a process for recovering heavy hydrocarbons by injecting steam into a horizontal well within a subterranean formation, closing in the well for a "soak period", and then producing the well while continuously injecting steam into the horizontal well.

2. Background of the Invention

World energy supplies are substantially impacted by the world's heavy oil resources. It has been estimated that heavy oil may comprise as much as approximately 2,100 billion barrels of the world's total oil reserves. Therefore, processes for economically recovering oil from these viscous reserves are of extreme importance.

Asphalt, tar, and heavy oil are typically deposited near the surface with overburden depths that span a few feet to a few thousands of feet. In Canada, vast deposits of heavy oil are found in the Athabasca, Cold Lake, Celtic, Lloydminster and McMurray reservoirs. In California, heavy oil is found in the South Belridge, Midway Sunset, Kern River and other reservoirs.

In large Athabasca and Cold Lake bitumen deposits, oil is essentially immobile, i.e. unable to flow under normal natural drive, primary recovery mechanisms. Furthermore, oil saturations in these formations are typically large. This normally limits the injectivity of a fluid (heated or cold) into the formation. Moreover, many of these deposits are too deep below the surface to be mined effectively and/or economically.

In-situ techniques of recovering viscous oil and bitumen have been the subject of much previous investigation. These techniques can be split into three categories: (1) cyclic processes involving injecting and producing a viscosity reducing agent: (2) continuous steaming processes which involve injecting a heated fluid at one well and displacing oil to a distant well(s); and (3) the relatively new Steam (or Solvent) Assisted Gravity Drainage process.

Each of these techniques have substantial limitations when used in the ecomonic recovery of very viscous hydrocarbons, e.g. those present in reservoirs such as Athabasca or Cold Lake. That is, cyclic steam or solvent stimulation in reservoirs such as these is severely hampered due to the fact that the injectivity of steam and/or solvent into this type of producing formations is very low. Some success with a fracturing technique has been obtained in the some reservoirs where there is no significant underlying water aquifer. However, if a water aquifer exists beneath the oil bearing formaton, fracturing during steam injection usually results in an early and large water influx during the production phase.

Also, with fracturing, it is very difficult to confine steam within the desired portion of the reservoir. These factors substantially lower the economic performance of such wells.

In addition, cyclic steaming techniques are not continuous thereby reducing the economic viability of the process. Clearly, these steam stimulation techniques in tight, heavy oil reservoirs appear limited.

Similar to cyclic steaming, continuous steam drive processes carried out in vertical wells are not technically or economically feasible in many of these very viscous, bitumen-type reservoirs. The mobility of the oil is simply far too small to allow the oil to flow from a cold production well as it does in other types of reservoirs. Injecting steam into one well and producing from an adjacent well is not practical unless a fracture is first formed in the producing formation. As will be understood in the art, fracturing between wells is very difficult to control. Hence, there are considerable operationing problems in attempting to use classical steam flooding in these heavy oil reservoirs.

Steam Assisted Gravity Drainage (SAGD) is disclosed in U.S. Pat. No. 4,344,485 which issued to Butler in 1982. SAGD uses a pair of horizontal wells connected by a vertical fracture. The process has several advantages over most steam stimulation or continuous steam injection processes. One advantage is that initial steam injectivity is not needed as steam rises by gravity above the upper well thereby replacing oil produced at the lower well. Another advantage is that since the process is gravity dominated and steam replaces produced oil, good sweep efficiency is obtained. Yet another advantage is since horizontal wells are utilized, good oil rates may be obtained by simply extending the length of the well to contact more of the oil bearing formation. In the SAGD process, steam is injected in the upper horizontal well while oil and water are produced through the lower horizontal well. Steam production from the lower well is controlled so that the entire process remains in the gravity dominated regime. A steam chamber rises above the upper well and oil warmed by conduction drains along the outside of the chamber to the lower production well.

This process appears to have the advantages of high oil rates and good overall recovery. Also, it can be used in the absence of a vertical fracture. However, one serious limitation of this process in practical application is the need to have two parallel horizontal wells—one beneath the other. Those skilled in the art of drilling horizontal wells will recognize the difficulty in drilling relatively long, parallel horizontal wells, one above the other, especially with any real accuracy in thin formations.

Other heavy oil recovery processes have also been proposed in which only a single, horizontal well is used. For example in U.S. Pat. No. 5,148,869 (Sanchez) and U.S. Pat. No. 5,215,149 (Lu), both use a single horizontal wellbore to inject steam through one flowpath while producing the heated heavy oil from a second flowpath. The steam injection is continuous but the region of the formation which undergoes heating is limited to a relatively small region surrounding the wellbore since the steam can not readily penetrate into the formation and must heat the contacted formation primarily by conduction. The same is implied in the paper: "Steam Circulation in Horizontal Wellbores", D. A. Best et al, SPE/DOE 20203, presented in Tulsa, Okla., Apr. 22–25, 1990.

Another recovery process of this type is one wherein steam is injected into a single horizontal wellbore to initially heat a heavy oil formation around the wellbore. The well is then shut-in and the formation is allowed to "soak"; see U.S. Pat. No. 4,116,275 (Bulter et al.). This allows the steam to heat a greater region of the formation since the steam now heats by convection as well as conduction. However, in known prior-art processes of this type, the well is merely opened after the soak period and is allowed to produce until the well is "drawn down"; i.e. the bottomhole pressure drops below an acceptable level for production. Even though the steam and shut-in cycles may be repeated, the well has a tendency to cool down during each production cycle which, in turn, results in the thickening of the heated oil (i.e. the viscosity of the oil increases as it cools) thereby requiring more steam and longer injection intervals during each cycle to raise the bottomhole temperatures and pressures back to those desired for the soak period.

SUMMARY OF THE INVENTION

The present invention provides a method for recovering viscous oil from a subterranean formation through a wellbore having a substantially horizontal section into the formation. The formation is initially heated by injecting steam into the horizontal section and circulating it back to the surface. This initial heatinq reduces the viscosity of the oil in the formation surrounding the wellbore so that the oil will flow into the horizontal section and will be produced to the surface with the circulating steam. Where steam circulation cannot be initiated without risking the fracturing of the formation, a pump may be used to produce the injected steam.

At the end of the initial heating period, production from the wellbore is ceased and the injection of steam is continued until a slug of steam is accumulated within and around the horizontal section of the well. Steam injection is then ceased and the well is allowed to "soak" for a period of time after which, first production and then steam injection are resumed. By continuously injecting steam while the well is being produced, the well is not "drawn down" as rapidly as is the case in prior art processes of this type.

When the oil in the produced fluids drops below an acceptable level, the production is ceased and a slug of steam is again allowed to build-up in the well after which the well is closed-in for another soak period. At the end of this soak period, production and the injection of steam are again resumed as before. This cycle is repeated until the production of oil drops below an economical recovery rate.

More specifically, in accordance with the present invention, highly viscous oil is recovered from a subterranean formation using a single, horizontal wellbore which is subjected to steam stimulation. First, a wellbore is drilled to penetrate the formation which has a substantially vertical section extending from the surface and a contiguous substantially horizontal section extending into the formation. The vertical section is cased and the horizontal section is preferably completed with a slotted liner or the like. After the wellbore is completed, steam is continuously circulated in and out of the horizontal wellbore at a pressure below the formation's fracture pressure thereby heating the formation surrounding the horizontal wellbore by conduction to reduce the viscosity of the viscous oil. This enables the heated oil to drain into the wellbore and thereby create voidage in the formation around—primarily above—the wellbore.

This step is continued until the temperature of the horizontal welbore reaches the saturation temperature of steam at the horizontal wellbore pressure. Thereafter, the production is ceased and a slug of steam is injected and accumulated in and around the horizontal section, still at a pressure below the formation's fracture pressure. The well is then shut-in and is allowed to soak for a period of time, preferably from 1 to 7 days. After the soak period, the well is then opened for production and the continuous injection of steam is resumed soon after oil appears in the produced fluids; i.e. 20 to 30% of the injected steam may have to be produced before any substantial oil shows up in the produced fluids. The steam is again injected at a pressure below the formation's fracture pressure. This step is continued until the oil in the produced fluids becomes unfavorable.

The sequence of injecting a slug of steam, soak period, and production and steam injection is repeated for a plurality of cycles until the rate of oil recovery becomes unfavorable. As the number of cycles increases, the size of each successive steam slug and respective soak period also increases. In some instances, the production of oil may also be assisted by pumping the produced fluids to the surface through the production tubing.

BRIEF DESCRIPTION OF THE DRAWING

The actual construction, operation, and apparent advantages of the present invention will be better understood by referring to the FIGURE, not necessarily to scale, which is a schematic, sectional view of a horizontal well utilized in carrying out the process of the present invention.

BEST KNOWN MODE FOR CARRYING OUT THE INVENTION

This invention is directed to a cyclic, steam stimulation method for removing immobile or highly viscous oil from a formation or reservoir through a horizontal well which penetrates into the formation. Referring to the FIGURE, the drawing illustrates a subterranean formation or reservoir 10 which contains a highly viscous oil and which lies below the earth's surface 12 beneath overburden 14. A well bore 16 having a substantial vertical section 18 and a contiguous substantially horizontal section 20 has been drilled to penetrate the formation 10 and to extend therein.

The wellbore 16 is cased down substantially to the beginning of the horizontal wellbore 20. The substantial length of the horizontal wellbore section 20 is lined with a liner 22 which, in turn, has slots 24 along its length. The horizontal wellbore 20 and surrounding formation are in fluid communication through slots 24. An injection tubing 26 is run inside the wellbore 16 from the surface to the far end of the slotted liner 22. The whole or part of injection tubing 26 is insulated to ensure that the quality of the injected steam exiting at the end of the tubing is as high as possible.

A production tubing 28 is run between the wellbore 16 and the injection tubing 26 form the surface to the lower end of the vertical section 18 of the wellbore. The annular space 30 between the vertical wellbore casing and the injection/production tubing may be filled with an inert gas, preferably nitrogen. The nitrogen blanket serves three major purposes: (1) it reduces heat losses to the overburden for better thermal efficiency and casing protection, (2) it initiates steam-lift production mechanism after flow-back, and (3) it provides a medium through which downhole (i.e. bottomhole) pressure can be measured at the surface. The appropriate gauges (not shown) can be provided at the surface in communication with the well annulus 30 to directly monitor both the bottomhole temperature and pressure as will be understood in the art.

After the well has been completed, formation 10 is initially conditioned or heated by continuously circulating steam down the well and into and out of the horizontal wellbore 20 at a pressure below the formation's fracture pressure and for a time sufficient to heat the formation surrounding the horizontal wellbore by transient conduction. It is important not to fracture the formation because once fractured, most of the injected steam will flow into the fracture thereby making it very difficult to heat the formation along the length of the horizontal wellbore. While circulating steam during this first step, the steam injection pressure and the steam circulation rate (hence, the bottomhole pressure) can be controlled by adjusting chokes or the like (not shown) which, in turn, are positioned in injection tubing 26 at the surface.

The steam circulates down and out the far end of the tubing 26 and back through annulus 32 between tubing 26 and liner 22 and then up to the surface through production tubing 28. The inert gas blanket in vertical annulus 30 prevents the steam from flowing up through the annulus 30. As the steam circulates within the horizontal wellbore 20, the slots 24 in liner 22 allow the steam to contact formation 10 to thereby heat the formation by transient conduction. Since the steam is being injected below the fracture pressure of formation 10 and since there is little voidage within formation 10 during this initial heating step, there will be no substantial penetration of the steam into the formation.

As a relatively small region of the formation 10 surrounding horizontal wellbore 20 heats up, the viscosity of the heavy oil in this region is reduced whereby the now less-viscous oil drains by gravity into the horizontal wellbore 20 through slots 24 in liner 22. This drainage of oil along with the ever present connate water from the pore spaces in formation 10 begins to create voidage within the formation. Once voidage has been created in the formation, the second step of the present invention can then be carried out; i.e. injection of a slug of steam after which the well is closed-in to allow the formation to "soak" for a period of time.

The first step, i.e. conditioning of the formation to initially heat the formation and thereby create voidage therein, is considered complete when the temperature within the horizontal wellbore 20 reaches the saturation temperature of the steam at horizontal wellbore pressure as measured at the surface through annulus 30. Another good indicator that the first step is complete is when the returned fluids (produced steam through production tubing 28) contains substantial amounts of produced oil. This first step of heating the formation can typically take from about 20 to 100 days or longer, depending on well and/or formation parameters, injection and production pressures, steam quality, circulation rates, etc.

After the formation 10 surrounding horizontal wellbore 20 has been conditioned (i.e. heated) and some voidage has been created in the formation, the production tubing 28 is closed and the injection of steam is continued through injection tubing 26. This injected steam which now has no way to return to the surface, accumulates as a "slug" within and around horizontal wellbore 20. Injection of steam continues until the bottomhole pressure in wellbore 20 approaches (i.e. nearly equals) the fracture pressure of formation 10. At this time, the injection of steam is ceased and the well is shut-in and the formation is allowed to "soak" for a period of time. Allowing the formation to soak results in heat being transferred from the steam by convective heating in addition to conductive heating. Heat transfer due to convective heating normally increases the effective thermal conductivity from the steam to the formation by as much as approximately 4 to 6 times over that which results from conduction heating alone. This results in the heated region surrounding the horizontal wellbore to extend further out into the formation and heat the additional oil therein.

The well remains shut-in for a defined soak period; e.g. from 1 to 7 days or longer depending on the particular field conditions involved, after which the production tubing 28 is opened and the well is again produced. In accordance with the present invention, soon after the production tubing 28 is opened for production, the continuous injection of steam is restarted through injection tubing 26. Continuous injection of steam starts when the wll starts producing oil, which may typically occur after from about 20 to 30% of the injected steam has been produced. This continuous injection of steam during the production following a soak period performs at least two important functions.

First, it helps to maintain the produced oil at its reduced viscosity by keeping it warm in and around the wellbore, thereby allowing the oil to flow to the surface without any substantially cooling, hence thickening, within the production tubing. Second, and at least equally as importantly, the bottomhole pressure in the well is not "drawn-down" substantially during the production step. That is, in typical "huff and puff" or similar steam operations, the well is merely opened after a soak period and the steam and produced fluids flow to the surface under the influence of the relatively high bottomhole pressure. Production is continued until the bottomhole pressure drops below an acceptable value at which time another slug of steam is injected, the well shut-in, and the soak and production cycles are repeated.

In the present invention, by continuously injecting live steam during the production step, neither the bottomhole pressure nor the temperature in the horizontal wellbore 20 will drop substantially. The pressure at which the steam is injected during the production step still should be below the fracturing pressure of formation 10 just as it was for the initial heating step.

Although the steam injected during production continues to carry heat to the horizontal wellbore 20, this heat will not result in any significant extension of the heated region within the formation since it is only heating by conduction. Accordingly, once substantially all of the oil from the previously heated region has flowed into wellbore 20, the oil in the production fluids will drop below an acceptable level. At this time, production tubing 28 is again closed and steam injection is continued until a slug of steam is accumulated within horizontal wellbore 20 as described above. The injection of steam is then ceased and the well is shut-in and allowed to soak for a second period after which it is reopened for production and injection of steam as described above. This cycle is repeated until substantially all of the oil which can be economically recovered has been produced.

As the cycles are repeated, a larger and larger region around wellbore 20 will be heated from which oil will drain into the wellbore. This creates a larger and larger voidage within the formation which, in turn, requires respective larger slugs of steam for each successive cycle. Further, since larger regions are being effected with each successive cycle, the length of the soak cycle will also increase. The actual size of any successive steam slug and/or the actual length of a respective soak period will depend upon the characteristics and conditions existing in a particular field operation.

Although steam is injected below the fracture pressure of the producing formation, some degree of local failure of sand in shear (dilation) takes place and is advantageous to the process as it facilitates the entering of steam into the formation, thus resulting in convective heating. Further, on a cyclic basis, the cold water equivalent of total injected fluids equals the total produced fluids, thus maintaining the average reservoir pressure at or near its original valve. This is a very important part of this process and results in higher recoveries of oil over those achievable by "huff and puff" or steam circulation alone. It is preferred that the steam quality be as high as possible to provide maximum heat to the formation and thereby increase oil production. Preferably, the steam is of at least 80% quality.

In another embodiment of the present invention, it may become desirable or necessary to pump the produced fluids to the surface rather than allowinq the fluids to flow to the surface due to the circulation of the steam. In such a modification, a pump (not shown) will be placed at or near the lower end of production tubing 28 to pick up the produced fluids and pump them to the surface through the production tubing.

What is claimed is:

1. A method for recovering viscous oil from a subterranean formation through a wellbore having a substantially vertical section extending from the surface and a contiguous substantially horizontal section extending into said formation; said method comprising:

(a) injecting steam down said wellbore and continuously circulating said steam through said horizontal section and back to the surface to heat said formation surrounding said horizontal section and the viscous oil therein to thereby reduce the viscosity of said viscous oil whereby said heated oil flows into said horizontal section of said wellbore;

(b) producing said heated oil alonq with the circulated steam;

(c) ceasing production from said formation while continuing to inject steam into said horizontal section of said wellbore until a slug of steam is accumulated within and around said horizontal section of said wellbore;

(e) ceasing injection of steam and shutting-in said wellbore and allowing said formation to soak for a period of time; and (f) producing fluids from said formation after said soak period while continuously circulating steam through said horizontal section of said wellbore.

2. The method of claim 1 wherein the pressure at which steam is injected into the wellbore is below the fracture pressure of said formation.

3. The method of claim 1 wherein production is ceased in step (c) when the temperature within the horizontal section of said wellbore is approximately equal to the saturation temperature of the steam at the pressure with the horizontal section of said wellbore.

4. The method of claim 1 including:

repeating the cycle of steps (c) through (f) when the amount of oil in the fluids being produced in step (f) drops below an acceptable level.

5. The method of claim 4 wherein the size of the slug of steam in step (c) and the length of the soak time in step (e) increases for each successive cycle.

6. A method for recovering viscous oil from a subterranean formation through a wellbore having a substantially vertical section which extends from the surface and a contiguous substantially horizontal section which extends into said formation; said method comprising:

(a) positioning a production tubing within said wellbore which extends from the surface to substantially the lower end of said vertical section of the wellbore;

(b) positioning an injection tubing within said wellbore which extends from the surface to the far end of said horizontal section of said wellbore;

(c) injecting steam continuously down said injection tubing and circulating the steam back to the surface through said production tubing to heat the formation surrounding the horizontal wellbore and the viscous oil therein to thereby reduce the viscosity of the viscous oil whereby said heated oil flows into said horizontal section of said wellbore;

(d) producing said heated oil through said production tubing along with the circulated steam;

(e) closing off said production tubing while continuing to inject steam through said injection tubing until a slug of steam is accumulated within and around said horizontal wellbore;

(f) closing off the injection tubing and allowing the formation to soak for a period of time;

(g) opening said production tubing to produce fluids from said formation through said production tubing;

(h) opening said injection tubing when oil begins to appear in said produced fluids; and (i) continuously injecting steam through said injection tubing while continuing to produce fluids through said production tubing.

7. The method of claim 6 wherein the pressure at which steam is injected into the wellbore is below the fracture pressure of said formation.

8. The method of claim 6 wherein production is ceased in step (e) when the temperature within the horizontal section of said wellbore is approximately equal to the saturation temperature of the steam at the pressure with the horizontal section of said wellbore.

9. The method of claim 6 including:

repeating the cycle of steps (e) through (i) when the amount of oil in the fluids being produced in step (i) drops below an acceptable level.

10. The method of claim 9 wherein the size of the slug of steam in step (e) and the length of the soak time in step (f) increases with each successive cycle.

* * * * *